United States Patent [19]

Lahr

[11] 4,415,157

[45] Nov. 15, 1983

[54] TWO-WAY SLOTLESS ROAD RACING GAME

[75] Inventor: Robert G. Lahr, New York, N.Y.

[73] Assignee: Ideal Toy Corporation, Secaucus, N.J.

[21] Appl. No.: 306,043

[22] Filed: Sep. 28, 1981

[51] Int. Cl.[3] ..... A63F 9/14; A63H 18/12

[52] U.S. Cl. ..... 273/86 B; 46/262; 104/304; 238/10 A

[58] Field of Search ..... 273/86 B; 46/262; 104/304, 305; 238/10 E, 10 F, 10 A

[56] References Cited

U.S. PATENT DOCUMENTS

| | | | |
|---|---|---|---|
| 2,717,557 | 9/1955 | Seyffer | 104/304 X |
| 3,391,490 | 7/1968 | Evans | 104/304 X |

FOREIGN PATENT DOCUMENTS

| | | | |
|---|---|---|---|
| 2903519 | 8/1980 | Fed. Rep. of Germany | 273/86 B |
| 2935531 | 3/1981 | Fed. Rep. of Germany | 273/86 B |

*Primary Examiner*—Anton O. Oechsle
*Attorney, Agent, or Firm*—Richard M. Rabkin

[57] ABSTRACT

A toy vehicle game includes a relatively flat slotless track having spaced sidewalls defining a pair of lanes therebetween. A pair of toy vehicles each having a body, a reversible electric motor and means for steering and/or biasing said vehicle into one or the other of the lanes depending upon the polarity of current supplied to the vehicle are provided for use on the track. Current is selectively and independently provided to the toy vehicles through current supply strips on the track and control means allows independent reversal of current supplied to the vehicles. Current pick-ups are provided on the vehicles in predetermined relation to one another and to the current supply strips on the track so that each vehicle is respectively associated with only one of the current supply strips, regardless of the direction of travel of the vehicle on the track.

10 Claims, 10 Drawing Figures

TWO-WAY SLOTLESS ROAD RACING GAME

The present invention relates to toy vehicle games and, more in particular, to a toy vehicle game in which toy vehicles can move in opposite directions on a track.

In recent years a highly popular toy vehicle game has been developed known generally as "slotless racing." Slotless racing was found to be an improvement over previously proposed "slot car" type games which have only speed control systems since the slotless race games permit the vehicles to move from one lane to another on the track without the constraint of a guide slot.

One popular type of slotless game is disclosed in U.S. Pat. No. 4,078,799 and has been sold by the Ideal Toy Corporation as its "Total Control Racing" or "TCR" set. This particular type of game uses independently controlled toy vehicles having reversible electric motors wherein current is selectively and independently supplied to the vehicles for both speed control and steering. In particular, by reversing the polarity of current supplied to the motors in such vehicle the vehicle will be biased into one or the other lanes on the track. In such games current is supplied from three evenly spaced current supply strips in the track to a pair of current pick-up shoes or contacts on the toy vehicles. One of the pick-up shoes contacts a ground strip in the lane and the other shoe contacts one of the other two current supply strips in each lane.

By this arrangement in the previously proposed slotless race game, the toy vehicles could move on the track in the same direction and be separately and independently controlled. However, with that arrangement it was not possible for the vehicles to be placed on the track in opposite directions since then the wrong contact shoe on at least one of the vehicles would be engaged with the wrong current supply strip and the vehicle would not operate or would operate in reverse. Thus, in setting up the game and in playing that game, the players must always place the toy vehicles in the track in the same start direction.

While this game is highly popular, it has the constraint that the vehicles must always move on the track in the same direction. Thus, there could not be crossovers or T-intersections which might cause the toy vehicles to move about the track in some direction other than that in which it was originally placed. Therefore, there is not an absolute degree of freedom of movement for toy vehicles on the track.

It is an object of the present invention to overcome the limitations of previously proposed slotless toy vehicle games wherein toy vehicles were constrained to move in the same direction on the track.

Another object of the present invention is to provide a toy vehicle game wherein the toy vehicles may move on the track in either direction while changing lanes.

A further object of the present invention is to provide a toy vehicle game in which separately controllable vehicles can move from one lane to another to pass one another and can move through intersections in directions opposite from that in which they were originally placed at the start of the game.

A further object of the present invention is to provide an improved toy vehicle game.

Yet another object of the present invention is to provide a toy vehicle game of the character described which is relatively simple in construction and durable in operation.

Yet another object of the present invention is to provide a toy vehicle game as well as a control system therefor, which is relatively simple and economical to manufacture.

In accordance with an aspect of the present invention, a toy vehicle game is provided which includes a track having at least two vehicle lanes thereon. A pair of separately controllable toy vehicles having electric motors therein and a plurality of current collectors mounted thereon for collecting current from the track are also provided. These vehicles each have at least one drive wheel operatively connected to and driven by a reversible electric motor therein. A control system for controlling at least the speed of movement of the toy vehicles is also provided which includes at least three electrically conductive contact strips on the track in each of the lanes located in generally parallel relation to each other. Each strip in each lane is electrically connected to a corresponding strip in the other lane to define pairs of electrically connected contact strips with one of the pairs of strips being connected to electrical ground. Means are provided for separately controlling current flow to the other two pairs of strips thereby to separately control the speed of the vehicles. One of the current collectors on each of the vehicles is positioned to contact the contact strip connected to ground regardless of the direction of travel of the vehicles. The other of the current collectors on each of the vehicles are positioned thereon and correlated to the positions of the other contact strips such that the current collectors on one vehicle will only contact the contact strip of one of the pairs regardless of the direction of travel of the vehicle on the track while the current collectors of the other vehicles will only contact the contact strip of the other pair regardless of its direction of travel. Thus, the toy vehicles may be separately and independently controlled while moving in either lane and in either direction.

The above and other objects, features and advantages of this invention will be apparent in the following detailed description of illustrative embodiments thereof which are to be read in connection with the accompanying drawings wherein.

Figure 1:
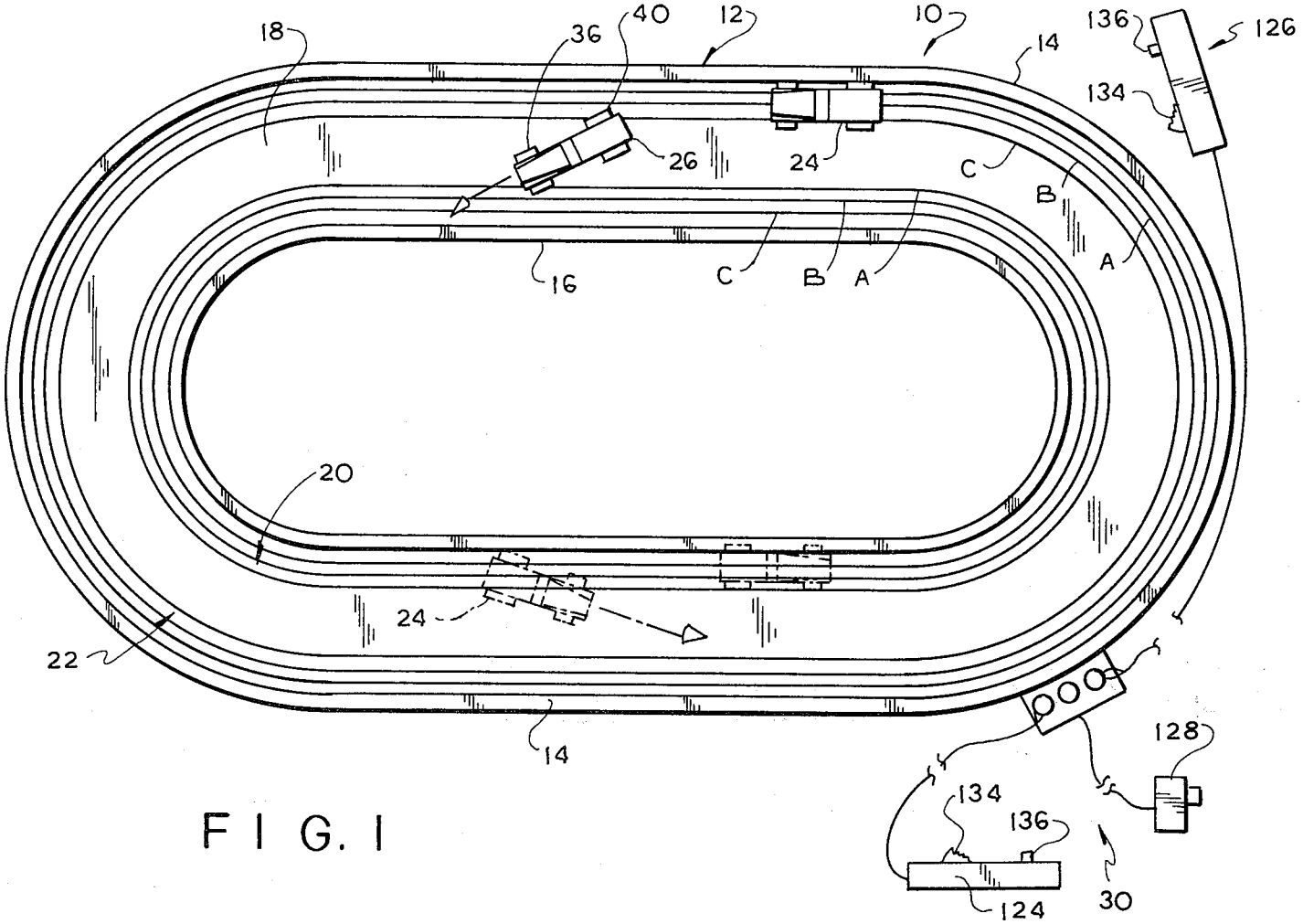
FIG. 1 is a schematic plan view of a toy vehicle game of the present invention.

Referring now to the drawings in detail, and initially to FIG. 1 thereof, a toy vehicle game 10 constructed in accordance with the present invention includes an endless plastic track 12 having a pair of laterally spaced upstanding sidewalls 14, 16 and a roadbed or tread surface 18 extending therebetween. Roadbed 18 has a width sufficient to define at least two vehicle lanes 20, 22 thereon along which a plurality of vehicles can be operated.

In the illustrative embodiment of the present invention, the toy vehicle game includes operator controlled vehicles 24, 26 which are of substantially identical construction except for the arrangement of their current collectors or shoes as described hereinafter.

Basically, the game of the present invention is constructed in accordance with the teachings of U.S. Pat. No. 4,078,799 and the product sold under the trademarks "Total Control Racing" and "TCR" by Ideal Toy Corporation. As described in that patent and as used in the "TCR" product, the two toy vehicles 24, 26 are separately controlled by the players through a control system 30 which enables the players to vary current supplied to the electric motors in the vehicles, thereby to vary the vehicle speed. The controllers also enable the players to change the polarity of current supplied to the respective vehicle motors whereby the vehicles can be switched by the players from one lane to the other.

Figure 3:
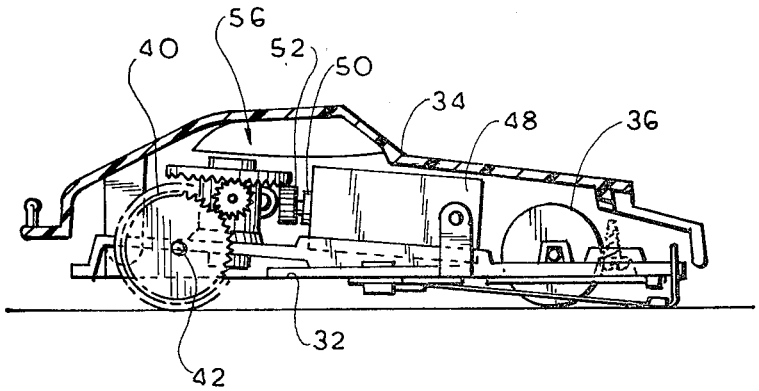
FIG. 3 is a longitudinal sectional view of one of the toy vehicles used in the game of FIG. 1.

One of the toy vehicles adapted for use in the present invention is illustrated in FIG. 3. As seen therein, the vehicle includes a frame or chassis 32 of any convenient construction and a removable plastic body or shell 34 which may be snap fit on frame 32 in any convenient manner. A pair of front wheels 36 are rotatably mounted on the frame while rear wheels 40 are rotatably mounted for independent rotation on shaft 42 rotatably mounted in frame 32. One of the drive wheels 40 is fixed on shaft 42 by a spleen or the like while the other of the wheels is freely rotatably mounted on the shaft.

Power for driving the toy vehicle is supplied from a DC electric reversible motor 48 mounted on frame 32 in any convenient manner. The electric motor is of conventional DC construction and includes a rotary output member or shaft 50 connected to the rotor of the motor in the usual manner. In the embodiment illustrated in FIG. 3, a spur gear or output drive element 52 is secured to shaft 50 for rotation therewith. This output member is drivingly engaged with transmission system 56 (described in detail in U.S. Pat. No. 4,078,799) which is responsive to the direction of rotation of the output drive element (i.e. the direction of rotation of output shaft 50 of motor 48, due to the polarity of current supplied to the motor) to selectively drive one or the other of drive wheels 40.

In the game illustrated in FIG. 1, when toy vehicle 24 is in the outside lane 22, as shown, and power is supplied to its right wheel, as a result of the polarity of current supplied to motor 48, the toy vehicle will be caused to move from the outer lane to the inner lane (as is shown occurring with vehicle 26). When this occurs the front end of the vehicle will engage inner wall 16 of the track and the continued drive of its right wheel will cause the vehicle to move along wall 16 in inner lane 20 of the track. Of course, if the vehicle is moving at a relatively high rate of speed as it goes about a curve in the track it may be propelled by centrifugal force into the outer lane. However, if the drive to the righthand wheel is maintained it will move inwardly again to the inner lane as previously described.

On the other hand, when the polarity of current supplied to motor 48 is reversed crown gear 58 will rotate in the opposite direction thereby driving the left wheel of the vehicle so that this wheel is driven while the right wheel is free to rotate. When the left wheel of the vehicle is driven in this manner a bias is applied to the vehicle which will cause it to move to the right. Thus, as illustrated in FIG. 1 by vehicle 24 shown in dotted lines, when the vehicle is in the inner lane 20 of track 12 and the polarity of current flow to motor 48 is changed so that its left wheel is driven, the vehicle will be biased toward its right into outer lane 22. Because of the transmission arrangement used in the toy vehicle, the vehicle will always be propelled in a forward direction regardless of the direction of rotation of the output of the motor.

As described in U.S. Pat. No. 4,078,799 current is supplied to the toy vehicles and track surface 18 through a plurality of electrical contact strips in each of lanes 20, 22. In the illustrative embodiment of the invention, each lane is provided with three contact strips A, B and C respectively. The strips are formed of an electrically conductive metallic material and are embedded in the track so that they are substantially flush with the surface of the track and present no obstacle to the movement of the vehicles from one lane to the other. Current is supplied to the strips as described hereinafter and is collected by the current collectors mounted on frame 32 of the toy vehicles in predetermined locations.

As further described in U.S. Pat. No. 4,078,799 and as used hereafter in the present invention, the contact strips in each lane are paired with each other, i.e. the A strip in one lane is electrically connected to the A strip in the other lane, the B strips are connected to each other and the C strips are connected to each other. The C strips are connected to electrical ground and the A and B strips are provided to separately supply current and control polarity of the current to the respective vehicles so that two vehicles can operate in the same lane and still be separately controlled.

For these reasons, as described in U.S. Pat. No. 4,078,799, the current collectors on the vehicle were arranged therein to associate the respective vehicles with only one of the pairs of contact strips. For example, vehicle 24 will obtain current from strips B while vehicle 26 will obtain current only from strips A.

In U.S. Pat. No. 4,078,799 the current supply strips A, B and C were evenly spaced and the toy vehicles each had only two current pick-up shoes thereon. One of the shoes was a commonly placed shoe, on each vehicle, so that each vehicle had a pick-up shoe which would contact the ground strip C. The other shoe on each vehicle was differently placed. That is, the other shoe on one of the vehicles was positioned to contact only the A strip and the other shoe on the other vehicle was positioned only to contact the B strip. With this arrangement, for example, utilizing the evenly spaced strip array shown in FIG. 1, the vehicles could only be separately and independently controlled if they were placed on the track in the same direction at the start of play. If, for example, the vehicle having shoes which would contact strips B and C were placed on the track in the wrong direction (i.e. opposite that shown in FIG. 1), the shoe intended to contact the ground strip C would contact the A strip while the shoe intended to contact the B strip would still contact the B strip. Since there would be no connection of the vehicle's motor to ground, the vehicle would not operate. Therefore, it would not be possible to use this toy vehicle in the game to operate in an opposite direction from that predetermined by the current supply strip array.

This problem is overcome by the present invention wherein the current supply strips are positioned with respect to each other and the pick-up shoes on the toy vehicle so that the vehicles will operate regardless of their position on the track. That is, regardless of the lane they are in and the direction in which they are faced.

Figure 3A:
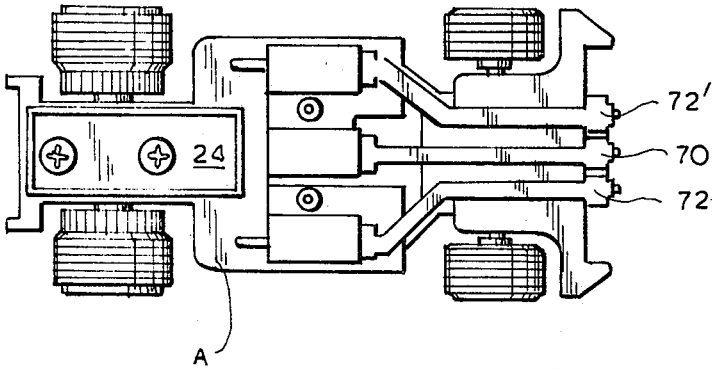
FIG. 3A is a bottom plan view of the toy vehicle of FIG. 2 showing the positioning of the current pick-up shoes therein.
Figure 3B:
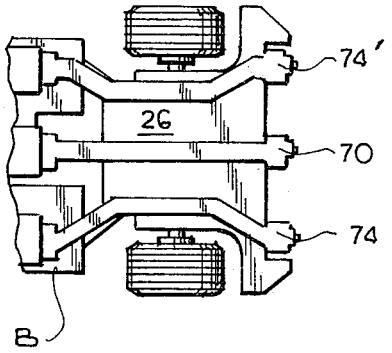
FIG. 3B is a bottom plan view similar to FIG. 3A of the other toy vehicle used in the game of FIG. 1.
Figure 4:
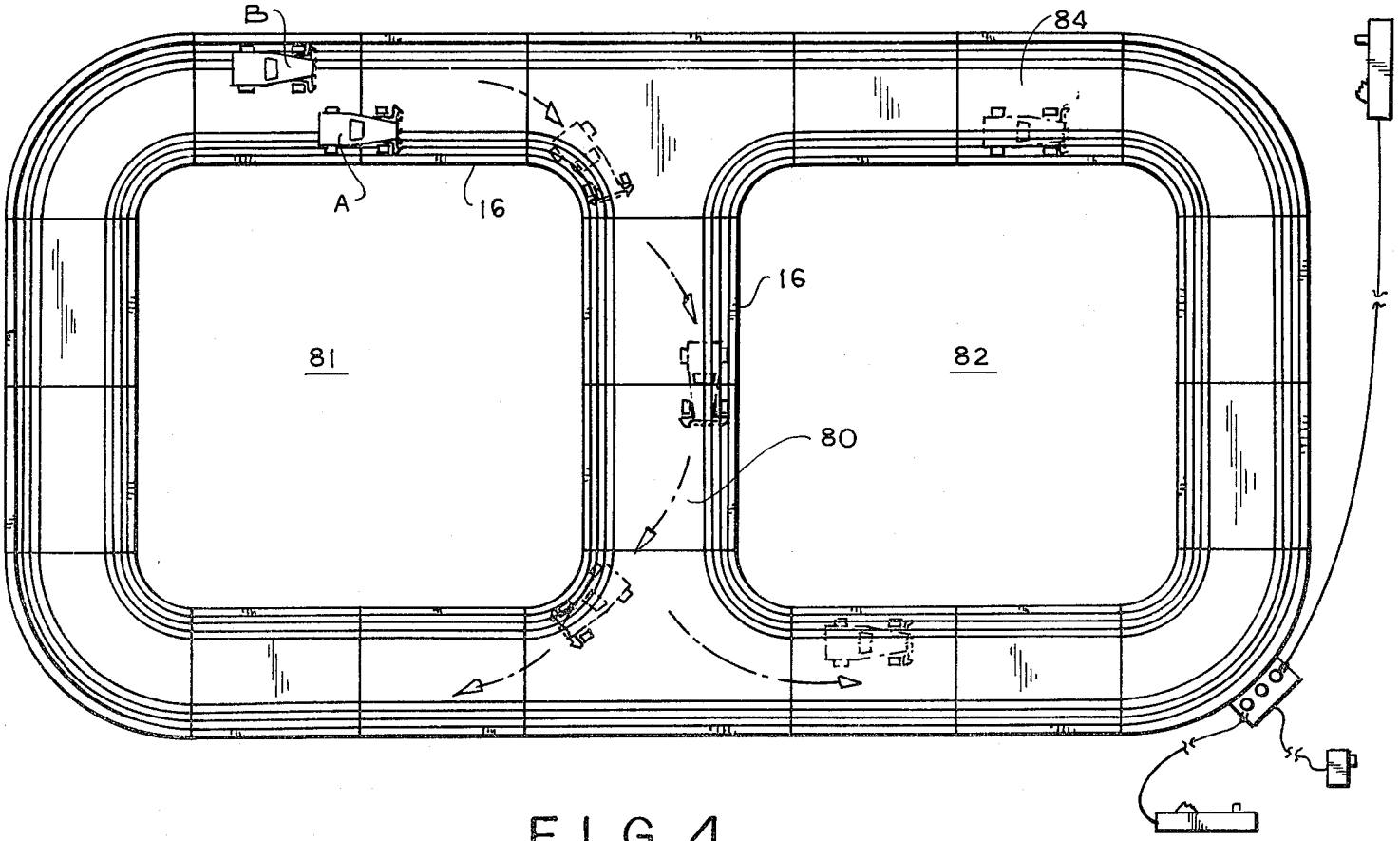
FIG. 4 is a schematic view of an embodiment of the toy vehicle game of the present invention having a figure-8 configuration.
Figure 5:
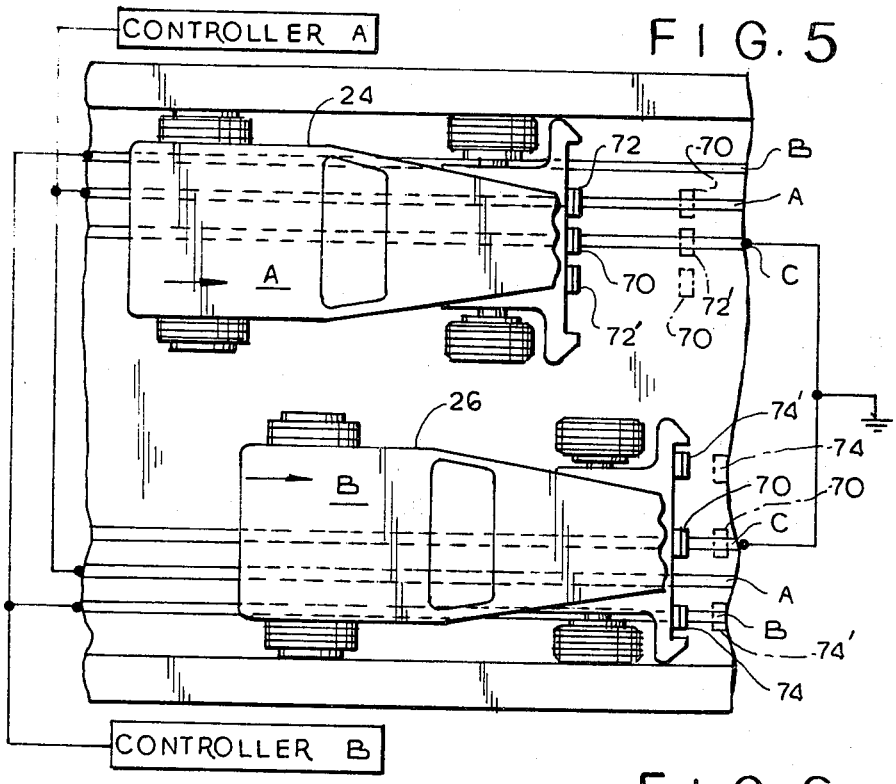
FIG. 5 is an enlarged view of a portion of a track section and two different toy vehicle cars thereon constructed in accordance with the present invention.

For example, as shown in FIGS. 1 and 5, the current supply strips (labeled A, B and C for convenience) are evenly spaced from each other in each lane. However, in this case there are three current pick-up shoes on each car but the pick-up shoes on car 24 (also labeled car A) and the current pick-up shoes on car B (also labeled car 26) are not spaced in the same manner. For example, more specifically, both car A and car B have a pick-up shoe 70 located approximately along its center line, to contact the ground strip C, while car A also has two closely spaced pick-up shoes 72, 72' while car B has two much more widely spaced pick-up shoes 74, 74'. This is also shown more clearly in FIG. 3*a* and 3*b*. With this contact shoe arrangement, as seen in FIG. 4, the upper shoe 72 of car A contacts strip A in the upper lane while lower shoe 74 on car B contacts strip B in the inner lane. If the cars are reversed, as shown in dotted lines representing the pick-up shoes, then the other of the pick-up shoes 72', 74' contacts strips A or B, respectively. This enables the toy vehicles to operate in either direction on the track. Also, as will be appreciated, the cars will operate in the same manner regardless of which lane they are in. Thus, the cars can be separately and independently controlled regardless of their lane or their direction of travel.

Figure 6:
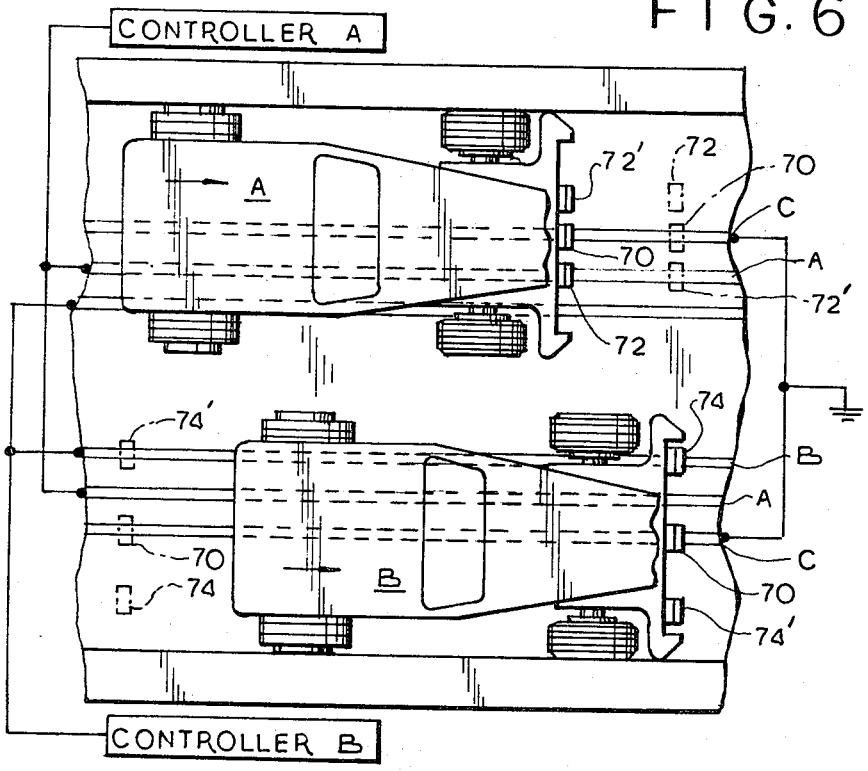
FIGS. 6, 7 and 8 are additional embodiments of the track and current supply strips arrangement used in accordance with other embodiments of the invention.

Another variation of this construction is illustrated in FIG. 6. In this case, the three current supply strips are spaced further from the sidewalls of the track than in the embodiment of FIG. 5. Again, the current pick-up shoes on car A are closely spaced while those on car B are more widely spaced, with the spacings being related to the spacing of the current supply strips in the track so that car A's pick-up shoe 70 will always contact strip C while its shoes 72, 72' will only contact strips A. On the other hand, the pick-up shoe 70 of car B will also only contact strip C while its shoes 74, 74' will only contact strip B, as illustrated in both solid and dotted lines in the drawings.

Of course, the contact shoes are connected to the electrical motor in the vehicle in any convenient manner, as described in the above-mentioned patent. Ground shoe 70 is connected to one side of the motor and pick-up shoes 72, 72' are jointly connected to the other side of the motor. The shoes can be of any convenient construction known in the art, as also illustrated in U.S. Pat. No. 4,078,799.

Figure 7:
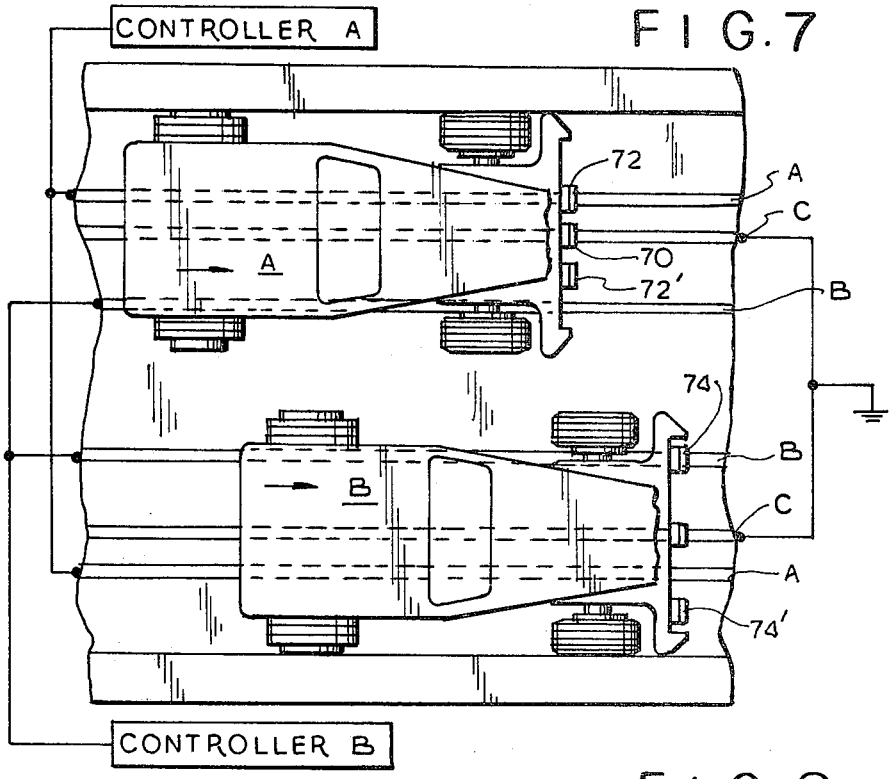
Figure 8:
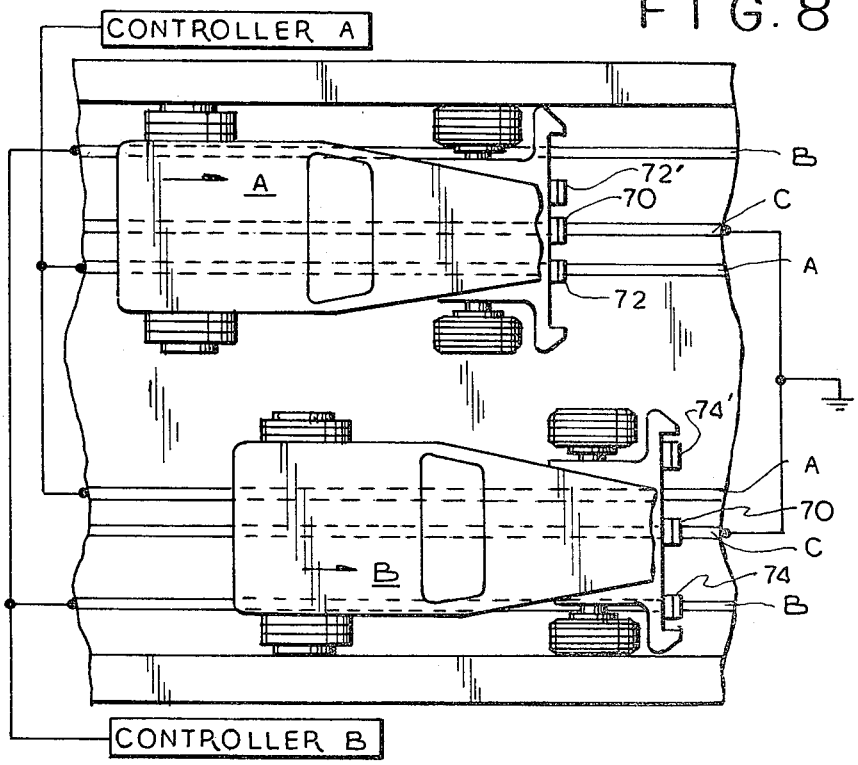

Two other and further embodiments of the invention are illustrated in FIGS. 7 and 8. In these cases, the supply strips in each lane are unevenly spaced. In both cases, the ground strip is the center strip so that again the center contact 70 on each toy vehicle will be the ground pick-up shoe. In FIG. 7, the B strips are spaced further away from the ground strip than the A strip while the reverse is true in FIG. 8. But in each case, each car is associated only with one of the supply strips A and B regardless of the lane the car is in or the direction it is placed on the track.

As presently advised, the embodiment of FIG. 5 is preferred since the outer driving wheel of each car will be engaged with the track when it is in a particular lane. For example, when car A is in the position shown in solid lines in FIG. 5 its outer rear wheel is driving to bias it into the adjacent sidewall. Since that wheel is on the track and not on any current supply strip, there is better traction for the vehicle. If the outer drive wheel runs on a current supply strip, as for example, may be the case in the embodiment of FIG. 6, there would be less traction and thus less force holding the vehicle in its lane.

Figure 2:
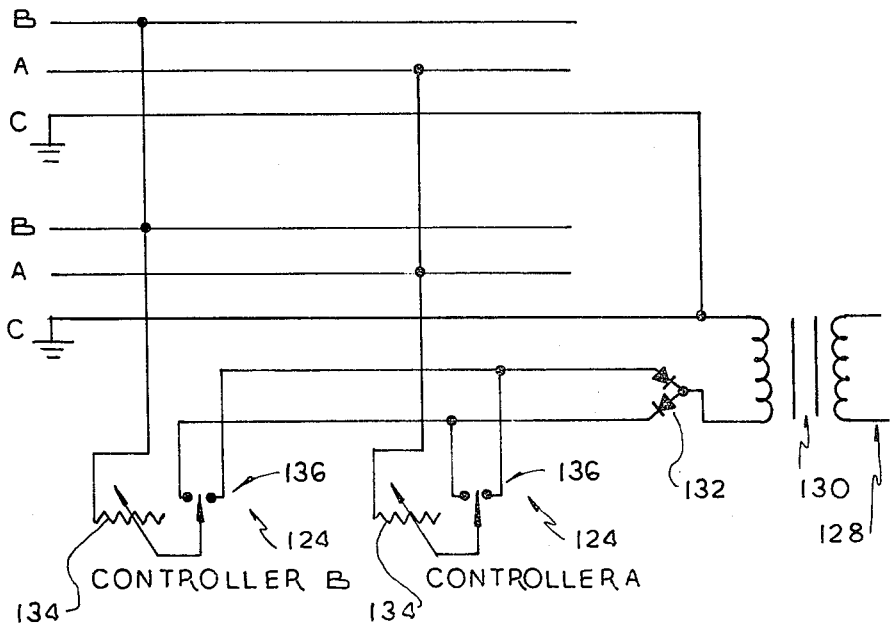
FIG. 2 is a schematic electrical circuit diagram of the electrical control system for the toy vehicle game of FIG. 1.

The specific control system for supplying current to the current supply strips is substantially identical to that used in the Ideal Toy Corporation "TCR" game and shown in U.S. Pat. No. 4,078,799. As seen in FIG. 2, this control system includes respective controllers 124, 126 by which the players can control the vehicles 24, 26, respectively. Essentially, the control system includes a plug 128 by which the system can be connected to any electrical AC power source and it includes a transformer 130. Power is supplied from transformer 130 through a half-wave rectifier 132 including two diodes connected as shown to separately supply current to controllers 124, 126. Each controller is provided as a hand-held unit and includes a variable resistor 134 operated as a trigger on the unit, as well as a single pole double throw switch 136. Current from controller 124 is supplied through its variable resistor 134 to the contact strips B and current from controller 126 is supplied through its variable resistor to contact strips A. The variable resistors may be of any convenient construction to permit the operators to vary the current supplied to their respective contact strips and thus, their respective vehicles in order to vary the speed of the vehicles.

The polarity of the current supplied to the toy vehicles is independently controlled by switches 136 so that the polarity of current supplied to motor 46 of the respective vehicles, as controlled by the respective controllers, will vary in accordance with the position in which switches 136 are placed. By this arrangement, each player using his controller 124 or 126 can control the speed of his vehicle along track 12 and he can also variably position his vehicle along the track simply by changing the polarity of current supplied to the vehicle.

As a result of the arrangement of the present invention which enables toy vehicles to operate in either direction, the track can be arranged so that it forms a Figure-8 or other irregular configuration so that it would be possible for the vehicle to change the direction of its travel along the track as a result of the path it might follow.

For example, as illustrated in FIG. 4, where a Figure-8 track system is provided, a toy vehicle may travel the center section of 20 the track and return in an opposite direction. This can occur, for example, as follows. Assuming a toy vehicle A is traveling in the upper left-hand portion of the track in FIG. 4 in the loop 81 and the operator controls the vehicle to move into center section 80 of the track, he controls the current supply so that the left wheel of the vehicle is powered, to bias the vehicle toward the inner wall of the track. The vehicle will follow the inner wall of the track, picking up current from the current supply strip A in the adjacent lane. The vehicle, thus, will follow around the inner wall into section 80. Centrifugal force, however, may force the vehicle away from that wall 16 of loop 81 toward wall 16 on the other side of section 80 in loop 82, as shown in dotted lines. If the player wishes to continue toward loop 82, he reverses the polarity of current supplied to the motor so that the right wheel of the vehicle drives. The vehicle will now follow inner wall 16 of loop 82 and follow that wall around. It will be apparent that when the vehicle is at the top section 84 of loop 82, it will be traveling in an opposite direction from that in which it started.

In this illustrative embodiment, the outer lane of the track is one continuous lane with the three current supply strips therein. The inner lanes on each loop, however, contain separate sets of current supply strips. The current supply strips in these lanes, however, are arranged in the same relative relationship to each other as in the outer lane and the corresponding current supply strips are connected to each other and to the current supply strips in the outer lane so that all current supply strips are paired. In other words, each lane has a C strip, a B strip and an A strip. Thus, the vehicles will operate the same regardless of the lane they are in.

Intersection piece 90 of the track (which may be formed in any known manner) may have a raised island 92 formed therein to help guide the toy vehicle into the intersection. However, to increase the degree of difficulty of the game, the island may be omitted. In addition, omission of the island enables a toy vehicle to coast across the inner lane of the intersection from one loop to the other without entering the cross-over.

It will be appreciated that, given the flexibility of the present invention as a result of the ability of the vehicles to be controlled regardless of the direction in which they are moving on the track, a great variety of different track shapes and intersection angles may be formed for the game thus, greatly enhancing the play value thereof.

Although illustrative embodiments of the present invention have been described herein with reference to the accompanying drawings it is to be understood that the invention is not limited to those precise embodiments, and that various other changes and modifications may be effected therein by one skilled in the art without departing from the scope or spirit of this invention.

What is claimed is:

1. A toy vehicle game comprising a track having at least two vehicle lanes therein, a pair of separately controllable toy vehicles having electric motors therein and a plurality of current collectors mounted thereon for collecting current from said track, said vehicles each having at least one drive wheel operatively connected to and driven by said motor therein; and a control system controlling at least the speed of movement of said toy vehicles including at least three electrically conductive contact strips on said track in each of said lanes located in generally parallel relation to each other, with each strip in each lane being electrically connected to a corresponding strip in the other lane to define pairs of electrically connected contact strips with one of said pairs of strips being connected to electrical ground; means for separately controlling current flow to the other two pairs of strips thereby to separately control the speed of the vehicles; one of said current collectors on each of said vehicles being positioned to contact the contact strip connected to ground regardless of the direction of travel of the vehicle; the other of said current collectors on each of said vehicles being positioned thereon and correlated to the positions of the other contact strips such that one of said other current collectors on each vehicle will only contact the contact strip of one of said pairs of electrically connected contact strips regardless of the direction of travel of the vehicle on the track whereby the vehicles may be separately controlled while moving in either lane and in either direction.

2. A toy vehicle game as defined in claim 1 wherein said grounded contact strip is positioned between the other two strips in each lane.

3. A toy vehicle game as defined in claim 2 wherein one of said other strips in each lane is spaced further from the ground strip than the other strip.

4. A toy vehicle game as defined in claim 1 wherein said ground strips are adjacent to each other.

5. A toy vehicle game as defined in claim 1 wherein the ground strip is the furthermost strip in each lane away from the center of the track.

6. A toy vehicle game including a relatively flat slotless track having spaced sidewalls defining a pair of lanes therebetween; a pair of toy vehicles each having a body, reversible electric motor and means for steering said vehicle into one or the other of said lanes depending upon the polarity of current supplied to the vehicle's motor; means for supplying current of the same polarity to each reversible electric motor regardless of the direction of travel of said toy vehicles; means for selectively and independently reversing the polarity of current supplied to the motors of said toy vehicles regardless of the lane each vehicle is in and the direction in which the vehicle is traveling on the track.

7. A toy vehicle game including a track having at least two lanes, a pair of toy vehicles having reversible electric motors therein and a plurality of current collector contacts thereon for collecting current from said track, means in each of said vehicles responsive to the polarity of current supplied to the vehicle's motor for steering and/or biasing the respective vehicles into one or the other of said lanes, and a control system for separately supplying current to said vehicles including three electrically conductive contact strips in each of said lanes with each strip in each lane being electrically connected to a correspondingly positioned strip in the other lane to define electrically connected pairs of strips, one of which pairs is connected to electrical ground; means for electrically connecting said power source to said pairs of strips and means for selectively and independently revesing the polarity of current from said power source to the other two pairs of strips; said current collector contacts on said vehicles being positioned thereon in a predetermined relationship to each other and to the contact strips in said lanes such that one of said current collector contacts in each vehicle contacts the ground connected strip when in either lane and the other current collector contacts on one of the vehicles will only contact the contact strip of one of said other two pairs of strips regardless of the lane it is in or its direction of travel while the other current collector contacts on the other of the vehicles will only contact the contact strip of the other of said other two pairs of strips regardless of the lane that vehicle is in or its direction of travel whereby said vehicles are separately and independently controllable regardless of the lane they are in or their direction of travel.

8. A toy vehicle game as defined in any of claims 1, 6 or 7 wherein said track has at least one intersection therein where one of said lanes forms a turn while the other lane continues in a straight line.

9. A toy vehicle game as defined in claim 8 including at least two such intersections.

10. A toy vehicle game including a relatively flat slotless track having spaced side walls defining a pair of lanes therebetween; a pair of toy vehicles each having a body, reversible electric motor and means for steering said vehicle into one or the other of said lanes depending upon the polarity of current supplied to the vehicle's motor; means for supplying current of the same polarity to each reversible electric motor regardless of the direction of travel of said toy vehicle; and means separate from said means for supplying current for selectively and independently reversing the polarity of current supplied to the motors of said toy vehicles regardless of the lane each vehicle is in and the direction in which the vehicle is travelling on the track.

* * * * *